US007980919B2

(12) United States Patent
Zhou

(10) Patent No.: US 7,980,919 B2
(45) Date of Patent: Jul. 19, 2011

(54) BLASTING DEVICE FOR PREMIXED ABRASIVE SLURRY JET

(76) Inventor: Zhengcai Zhou, Anhui (CN)

( * ) Notice: Subject to any disclaimer, the term of this patent is extended or adjusted under 35 U.S.C. 154(b) by 602 days.

(21) Appl. No.: 11/795,437

(22) PCT Filed: Jan. 18, 2005

(86) PCT No.: PCT/CN2005/000081

§ 371 (c)(1),
(2), (4) Date: Jul. 17, 2007

(87) PCT Pub. No.: WO2006/076827

PCT Pub. Date: Jul. 27, 2006

(65) Prior Publication Data

US 2008/0299876 A1 Dec. 4, 2008

(51) Int. Cl.
*B24B 49/00* (2006.01)

(52) U.S. Cl. ..... 451/2; 451/99; 451/101

(58) Field of Classification Search ..... 451/2, 91, 451/99, 101

See application file for complete search history.

(56) References Cited

U.S. PATENT DOCUMENTS

| | | | | |
|---|---|---|---|---|
| 2,984,188 | A * | 5/1961 | Tuckey et al. | 417/379 |
| 3,039,234 | A * | 6/1962 | Balman | 451/36 |
| 3,556,682 | A * | 1/1971 | Sakamoto et al. | 417/102 |
| 3,605,556 | A * | 9/1971 | Erdmann | 91/50 |
| 4,037,992 | A | 7/1977 | Uchida et al. | 417/102 |
| 4,319,435 | A * | 3/1982 | Suzuki et al. | 451/3 |
| 4,392,345 | A * | 7/1983 | Geary, Jr. | 60/779 |
| 4,707,952 | A | 11/1987 | Krasnoff | 51/410 |
| 5,174,732 | A * | 12/1992 | Hoya | 417/394 |
| 2002/0011579 | A1* | 1/2002 | Hashish et al. | 251/63.5 |
| 2004/0060607 | A1* | 4/2004 | Wheeler | 137/825 |
| 2004/0087897 | A1* | 5/2004 | Hjertman | 604/70 |
| 2008/0296797 | A1* | 12/2008 | Broecker et al. | 264/109 |

FOREIGN PATENT DOCUMENTS

| | | |
|---|---|---|
| CN | 87207523 U | 3/1988 |
| CN | 2685603 Y | 3/2005 |
| WO | WO 87/02290 | 4/1987 |

OTHER PUBLICATIONS

International Search Report corresponding to International Application No. PCT/CN2005/000081 dated Nov. 17, 2005.

* cited by examiner

*Primary Examiner* — Maurina Rachuba
(74) *Attorney, Agent, or Firm* — Ohlandt, Greeley, Ruggiero & Perle, L.L.P.

(57) ABSTRACT

The present invention relates to a blasting device for premixed abrasive slurry jet. The device comprise a cylinder, in which defines a hydraulic oil side and a slurry side separated from each other hermetically, and the hydraulic oil side and the slurry side have ports for oil or slurry entry in and out respectively; hydraulic medium feeding system which is connected to the port of the cylinder for oil entry in and out through oil pipe; slurry jet system which is connected to the port of the cylinder for slurry entry in and out through slurry pipe; said cylinder has a sealed bladder to separate the hydraulic oil side and the slurry side. Friction between bladder and body become very little, as the slurry is ejected from the nozzle by utilizing the transformation of the bladder. So service life of the blasting device becomes longer. Furthermore, if the bladder mangles due to wear for use a long time, bladder can be renewed only. It is not necessary to renew the whole cylinder. So the cost of production cuts down.

7 Claims, 3 Drawing Sheets

BLASTING DEVICE FOR PREMIXED ABRASIVE SLURRY JET

BACKGROUND

1. Field of the Disclosure

This disclosure relates to a blasting device for producing a premixed abrasive slurry jet used for cutting the material in the field of high pressure water jet, especially a kind of blasting device for producing premixed abrasive slurry jets.

2. Discussion of the Background Art

At present, in the case of cutting some hard material, the predominant approach is to depend on the high pressure to drive the slurry carrying the mixture of water and sand in the cutting device to eject at a high speed, which would realize the cutting intention.

The conventional cutting device, e.g. the blasting device for producing a premixed abrasive slurry jet disclosed in the section 10.2.3 of the publication of High Pressure Water Jet Technology and Its Application (Shengxiong Xue et al., *High Pressure Water Jet Technology and Its Application*, China Machine Press, 1998.8). As shown in the FIG. 1, the device comprises hydraulic oil tank 1, high pressure pass 3 constituted with high pressure pump 2, oil return pass 4, electromagnetic change-over valve 5 connected to high pressure pass 3 and oil return pass 4, two hydraulic cylinders 6 in parallel with the top connected to electromagnetic change-over valve 5, hydraulic cylinder 6 formed by the cylinder block 7 and piston 8 which separates the cylinder block 7 into two sealed cavities. The bottom of the hydraulic cylinder 6 connects a slurry feeding pass 9 which contains a slurry case 10 and a diaphragm pump 11 and connects with a nozzle pass 12. During the cutting, the piston 8 in the cylinder block 7 would slide up and down in the hydraulic cylinder 6 under the high pressure hydraulic oil or slurry. The up-and-down movement would fill the slurry into the cavity or drive the slurry to jet out of the nozzle 12.

In the conventional device, the slurry to perform the cutting operation mainly consists of water and sand. While the piston 8 moves up and down in the cylinder block 7, the friction between the external surface of piston 8 and the inner surface of cylinder block 7 will cause abrasion. Such abrasion makes the originally two sealed cavities to lose the seal and then does not work any more. Therefore, a new hydraulic cylinder will be needed. However, the sliding friction would be essential between the piston 8 and the cylinder block 7. Such a consideration presents a strict requirement for the inner wall of the cylinder block 7. Therefore, the conventional hydraulic cylinder has some disadvantage, such as short life, difficult maintenance and high cost.

SUMMARY OF THE DISCLOSURE

One object of the present disclosure is to provide a kind of blasting device for producing a premixed abrasive slurry jet to reduce the abrasion.

Another object of the present disclosure is to provide a kind of blasting device for producing a premixed abrasive slurry jet which has advantages in extended life, easy maintenance and low cost.

This disclosure provides a kind of blasting device for producing a premixed abrasive slurry jet which comprises a hydraulic cylinder, in which defines a hydraulic medium side and a slurry side separated from each other hermetically, and the hydraulic medium side and the slurry side have ports for medium or slurry entry in and out respectively; a hydraulic medium feeding system which is connected to the port of the cylinder for medium entry in and out through the hydraulic medium pipe; a slurry jet system which is connected to the port of the cylinder for slurry entry in and out through the slurry pipe; the cylinder having a telescopic sealed bladder to separate the hydraulic medium side and the slurry side.

In one kind of blasting device for producing a premixed abrasive slurry jet provided by present disclosure, the feeding system of the hydraulic medium comprises a hydraulic tank which is connected to the port of the cylinder for medium entry in and out by medium pipe; a high pressure pump which is connected to the medium pipe between the hydraulic tank and the hydraulic cylinder to supply the hydraulic cylinder with the high pressure medium; an electromagnetic change-over valve located at the medium pipe between the high pressure pump and the hydraulic cylinder to drive the hydraulic medium in the medium pipe to flow towards the hydraulic cylinder in the forward direction and return to the hydraulic tank reversely or stop the flow; a control device for the electromagnetic change-over valve; and a circuit pipe to connect the electromagnetic change-over valve and the hydraulic tank.

In another kind of blasting device for producing a premixed abrasive slurry jet provided by present disclosure, the feeding and jet system of the slurry comprise a slurry tank which is connected to the port of the cylinder for slurry entry in and out through the slurry pipe; a diaphragm pump which is connected to the slurry pipe between the hydraulic tank and the hydraulic cylinder to supply the slurry to hydraulic cylinder; a control device for diaphragm pump which was located at the slurry pipe between the diaphragm pump and the hydraulic cylinder to control the slurry entry into the hydraulic cylinder; a nozzle connected to the port of the cylinder for slurry entry in and out through the slurry pipe; and a nozzle control device located at the nozzle pipe between the nozzle and the cylinder to control the nozzle pipe on and off.

In another kind of blasting device for producing a premixed abrasive slurry jet provided by present disclosure further comprises a overflow valve located at the pipe between the high pressure pump and the medium pipe.

In another kind of blasting device for producing a premixed abrasive slurry jet provided by present disclosure, the control device for diaphragm pump is a check valve.

In still another kind of blasting device for producing a premixed abrasive slurry jet provided by present disclosure, the control device for the electromagnetic change-over valve comprises a high and lower level controllers.

In yet another kind of blasting device for producing a premixed abrasive slurry jet provided by present disclosure, the port at the cylinder block has a bladder sensor.

According to the premixed abrasive slurry jet provided by present disclosure, the original piston installed in the cylinder block has been replaced by a bladder. The friction between bladder and body becomes very little, as the slurry is ejected from the nozzle by utilizing the transformation of the bladder. So the life of the blasting device becomes longer. Furthermore, if the bladder becomes broken from use for a long time, it can be easily changed. It is not necessary to change the whole cylinder. So the cost of production is reduced.

DETAILED DESCRIPTION OF THE PREFERRED EMBODIMENT

Figure 1:
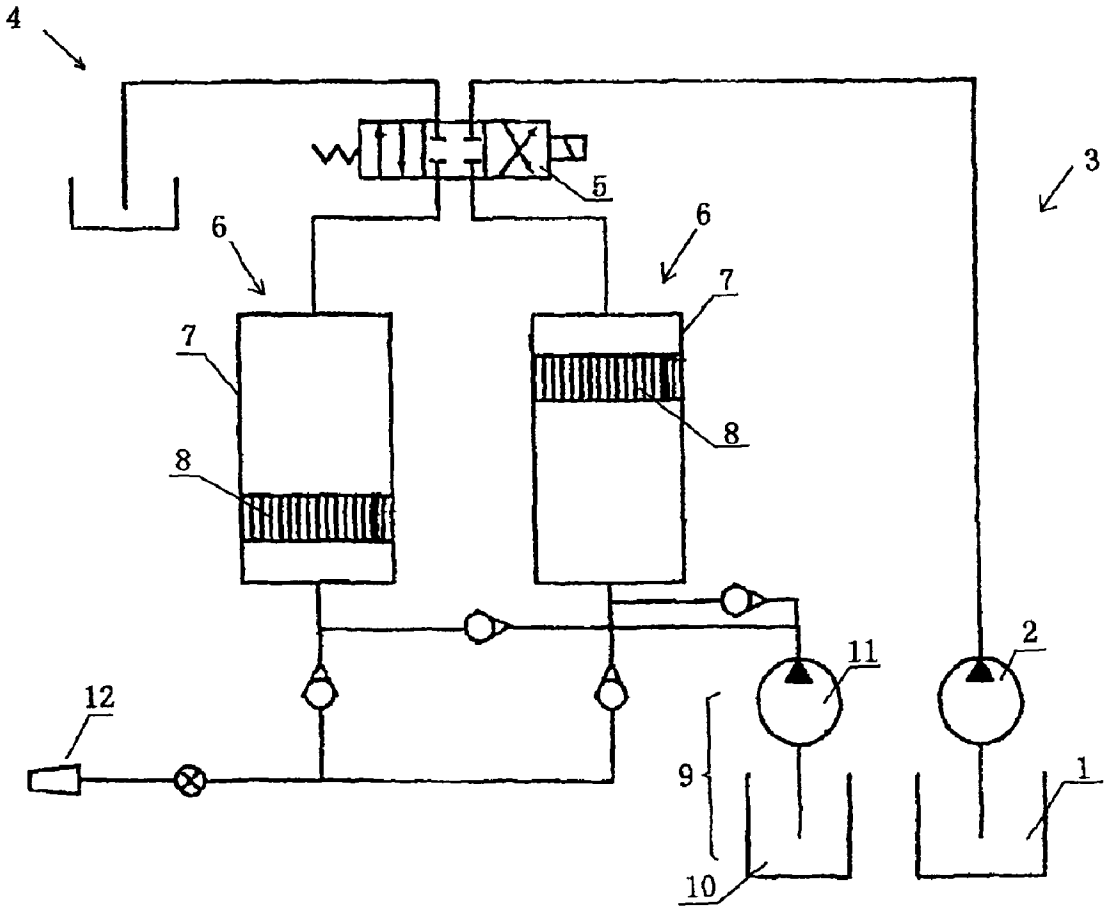
FIG. 1 is a schematic view of the conventional blasting device for producing a premixed abrasive slurry jet.

Preferred exemplary embodiments of the disclosure are depicted in the drawings and explained in greater detail in the following description, where the same reference numerals refer to the same or similar or functionally identical parts.

Figure 2:
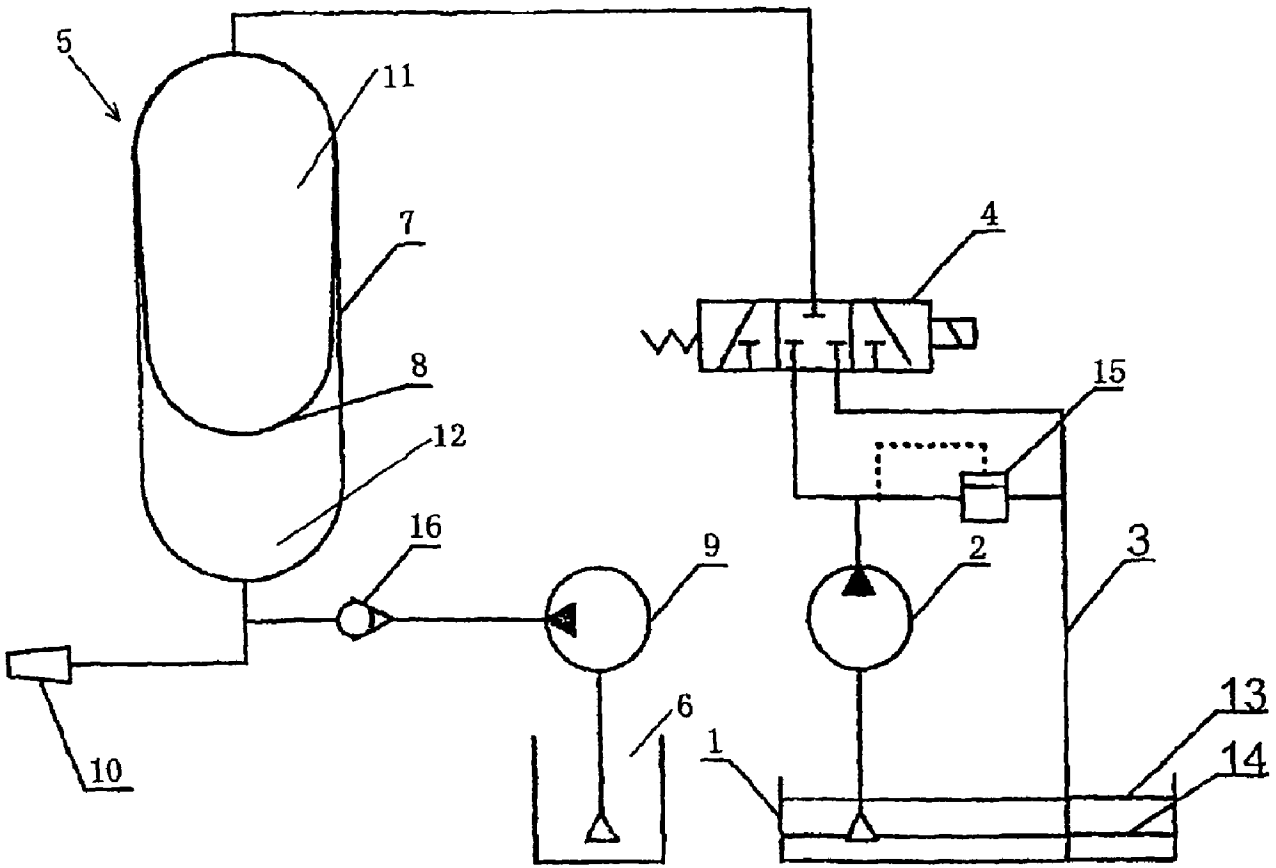
FIG. 2 is a schematic view of the blasting device for producing a premixed abrasive slurry jet provided by the present disclosure.

As shown in FIG. 2, the schematic view of the blasting device for producing a premixed abrasive slurry jet provided by the present disclosure, the blasting device comprises a hydraulic oil tank 1, a high pressure pump 2 connected to the hydraulic oil tank, a oil return pipe 3 connected to the hydraulic oil tank, a sensor 13 for high level at the hydraulic oil tank 1, a sensor 14 for lower level at the hydraulic oil tank 1; a electromagnetic change-over valve 4, a hydraulic cylinder 5. As shown in the FIG. 3, the hydraulic cylinder 5 consists of cylinder block 7 which is made of the stainless steel and bladder 8 which is made of the nitrile rubber. The bladder 8 divides the cylinder block into the hydraulic oil side 11 and the slurry side 12 and make them separated from each other hermetically. A port 7*b* is set up at the hydraulic oil side for the oil entry in and out, and A port 7*a* is set up at the slurry side for the slurry entry in and out. The port of bladder 8 aims at the port 7*b*. As shown in the FIG. 2, the electromagnetic change-over valve 4 connects with the high pressure pump 2, hydraulic oil tank 1 and port for oil entry in and out at the hydraulic cylinder 5. FIG. 2 also shows a slurry tank 6 to store the slurry, a diaphragm pump 9 connected to the pipe for the slurry tank 6 and a nozzle 10. The diaphragm pump 9 and nozzle 10 both connect with the port 7*a* for the slurry entry in and out at the cylinder block 7 in the hydraulic cylinder 5. There is a check valve 16 in the slurry pipe from the diaphragm pump 9 to the cylinder block 7 to control the pipe on and off, and there is a nozzle control valve (not shown) in the pipe from the nozzle 10 to the cylinder block 7.

At the beginning of the operation, the electromagnetic change-over valve 4 would connect with the hydraulic cylinder 5 and oil return pipe 3, and the high pressure pump 2 stops and meanwhile the diaphragm pump 9 works so that the slurry side 12 is full of the slurry from the slurry tank 6 used to cut the material. The high pressure oil at the cavity 11 would return to the hydraulic oil tank 1 via the oil return pipe 3, and at this time, the bladder is compressed. When the oil at the hydraulic oil tank 1 reaches the predetermined high level, the sensor 13 for high level would send a signal to the electromagnetic change-over valve 4 for the change-over which would connect the hydraulic cylinder 5 and the high pressure pump 2. Meanwhile, open the control valve for the nozzle 10 and close the diaphragm pump 9 with the high pressure pump 2 remain work. At this time, the high pressure oil would be filled into the bladder 8, i.e. the cavity 11, under the action of the high pressure pump 2. The action of high pressure oil makes the bladder 8 expanded and let the slurry in the cavity 12 eject out of the nozzle to cut the material. When the bladder 8 expands until it is almost of superposition with the cylinder block 7, almost all of the slurry has ejected out. At this time, the high pressure oil at the hydraulic oil tank 1 would reach the predetermined low level, and then the sensor 14 for low level would send a signal to the electromagnetic change-over valve 4 for the change-over which would connect the hydraulic cylinder 5 and oil return pipe 3 again. Meanwhile, close the control valve for the nozzle 10 and open the diaphragm pump 9 with the high pressure pump 2 stop. Then, the device comes back to the original status, one operation cycle has been finished.

According to the above embodiment, the conventional hydraulic cylinder with a piston is replaced by the hydraulic cylinder 5 that consists of the bladder 8 and cylinder block 7. As the bladder 8 is to eject the slurry by expansion and compression, there is no friction present between the bladder 8 and the cylinder block 7. Furthermore, even the friction exists, the friction between the bladder 8 and the cylinder block is only such one between the hard material and the soft one, thus, the friction is slight. Moreover, the bladder 8 divides the cylinder block into two sealed cavities, and such an arrangement would present no strict requirement for the inner wall of cylinder block 7, which accordingly lowers the manufacture cost of cylinder block 7. In the case of the bladder 8 worn, what needs to be done is to only replace the bladder 8, not the entire hydraulic cylinder, which not only lowers the manufacture cost but also provides the easy maintenance.

Figure 3:
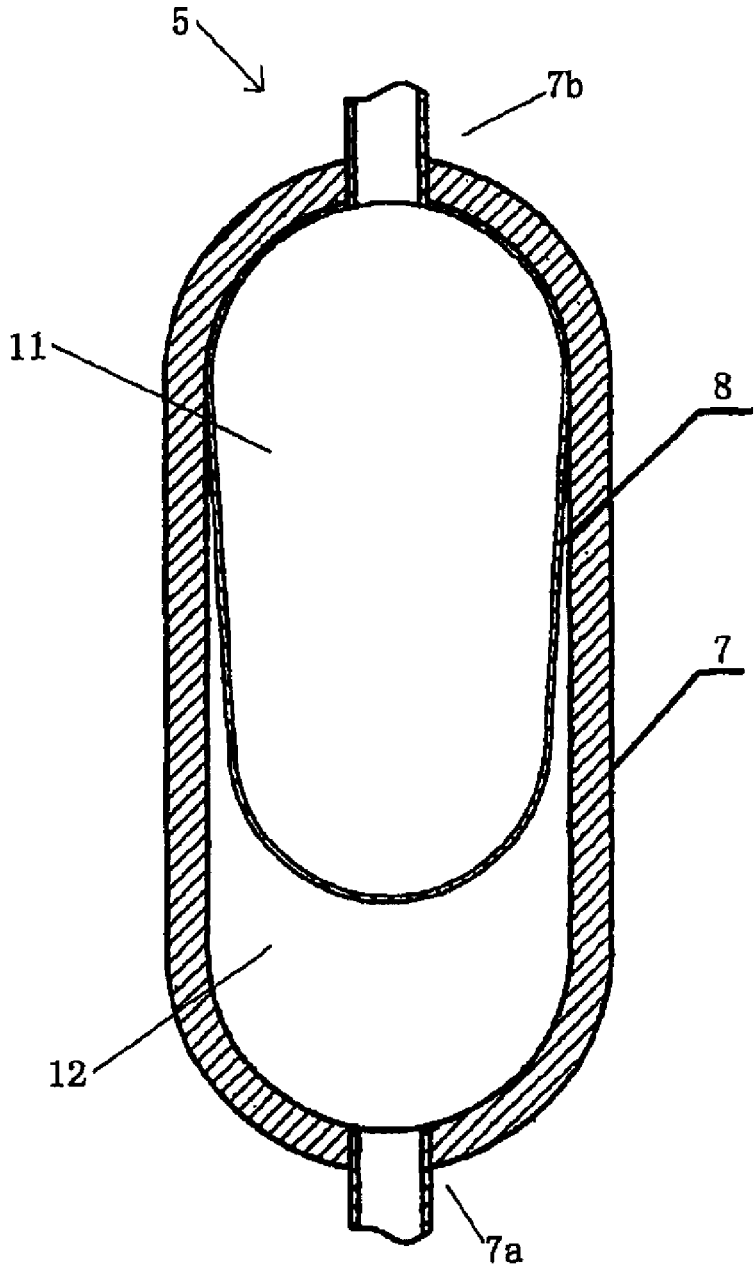
FIG. 3 is a sectional view of the hydraulic cylinder in the blasting device for producing a premixed abrasive slurry jet provided by the present disclosure.

Thus, according to another embodiment, the original hydraulic cylinder with the piston in the conventional blasting device for premixed abrasive slurry jet can be replaced by the hydraulic cylinder which consists of the bladder 8 and the cylinder block 7 as shown in the FIG. 3.

In addition, as shown in the FIG. 2, it is possible to install the overflow valve 15 between the high pressure pump 2 and the oil return pipe 3. The control valve of the diaphragm pump fitted in the pipe between the diaphragm pump 9 and the cylinder block 7 could also be of electronic type. The sensors 13 and 14 respectively for the high and lower level could also be replaced with the counterpart such as time control sensor and flow sensor, etc. Besides, for the better protection of bladder 8, a bladder sensor can be installed at the ports of 7*a* and 7*b* respectively at the cylinder block 7 to prevent the bladder 8 from being moved out of the cylinder block 7 reversely and meanwhile to prevent the bottom of bladder 8 from contacting the cylinder block 7 frequently which would result in the abrasion.

In addition, it is possible to use the port 7*a* of the cylinder block 7 in the hydraulic cylinder 5 to connect with the electromagnetic change-over valve 4 and the port 7*b* of the cylinder block 7 in the hydraulic cylinder 5 to connect with the diaphragm pump 9 and nozzle 10. Thus, the cavity 12 is used to contain the high pressure oil from the high pressure pump 2 and the cavity 11 is used to contain the slurry from the diaphragm pump 9.

The hydraulic cylinder could use the oil pressure or water pressure of hydraulic medium. The cylinder block 7 could be made by another material. To prevent the corrosion, it is reasonable to coat the anti-corrosion layer on the inner surface of the cylinder block 7. The bladder 8 could be made with such the material as with a large elastic deformation and wide expansion and shrinkage, e.g. nitrile rubber.

The above embodiment is not intended to limit the present disclosure, the skilled person in this field will appreciate that various modification are possible, without departing form the scope and the spirit of the present disclosure as disclosed in the accompany claims.

The invention claimed is:

1. A blasting device for premixed abrasive slurry jet, comprise:

hydraulic cylinder, in which defines a hydraulic medium side and a slurry side separated from each other hermetically, and the hydraulic medium side and the slurry side have ports for medium or slurry entry in and out respectively;

hydraulic medium feeding system which is connected to the port of the cylinder for medium entry in and out through medium pipe;

slurry jet system which is connected to the port of the cylinder for slurry entry in and out through slurry pipe;

wherein the said cylinder has a telescopic sealed bladder to separate the hydraulic medium side and the slurry side.

2. A blasting device for premixed abrasive slurry jet described in claim 1, wherein the feeding system of said hydraulic medium comprises:

a hydraulic tank which is connected to the port of the cylinder for medium entry in and out through the medium pipe;

a high pressure pump which is connected to the medium pipe between the hydraulic tank and the hydraulic cylinder to supply high pressure medium to the hydraulic cylinder;

a electromagnetic change-over valve which is located at the medium pipe between the high pressure pump and the hydraulic cylinder to drive the hydraulic medium in the medium pipe to flow towards the hydraulic cylinder in forward direction and to return to the hydraulic tank reversely or stop the flow;

a control device for the said electromagnetic change-over valve;

a circuit pipe to connect the electromagnetic change-over valve and the hydraulic tank.

3. A blasting device for premixed abrasive slurry jet, comprise:

hydraulic cylinder, in which defines a hydraulic medium side and a slurry side separated from each other hermetically, and the hydraulic medium side and the slurry side have ports for medium or slurry entry in and out respectively;

hydraulic medium feeding system which is connected to the port of the cylinder for medium entry in and out through medium pipe;

slurry jet system which is connected to the port of the cylinder for slurry entry in and out through slurry pipe;

wherein the said cylinder has a telescopic sealed bladder to separate the hydraulic medium side and the slurry side, wherein the feeding and jet system of said slurry comprise:

a slurry tank which is connected to the port of the cylinder for slurry entry in and out through the slurry pipe;

a diaphragm pump which is connected to the slurry pipe between the hydraulic tank and the hydraulic cylinder to supply slurry to the hydraulic cylinder;

a control device for diaphragm pump which was located on the slurry pipe between the diaphragm pump and the hydraulic cylinder to control the slurry entry into the hydraulic cylinder;

a nozzle connected to the port of the cylinder for slurry entry in and out through the slurry pipe;

a nozzle control device located on the nozzle pipe between the nozzle and the cylinder to control the nozzle pipe on and off.

4. A blasting device for premixed abrasive slurry jet, comprise:

hydraulic cylinder, in which defines a hydraulic medium side and a slurry side separated from each other hermetically, and the hydraulic medium side and the slurry side have ports for medium or slurry entry in and out respectively;

hydraulic medium feeding system which is connected to the port of the cylinder for medium entry in and out through medium pipe;

slurry jet system which is connected to the port of the cylinder for slurry entry in and out through slurry pipe;

wherein the said cylinder has a telescopic sealed bladder to separate the hydraulic medium side and the slurry side;

wherein the feeding system of said hydraulic medium comprises:

a hydraulic tank which is connected to the port of the cylinder for medium entry in and out through the medium pipe;

a high pressure pump which is connected to the medium pipe between the hydraulic tank and the hydraulic cylinder to supply high pressure medium to the hydraulic cylinder;

a electromagnetic change-over valve which is located at the medium pipe between the high pressure pump and the hydraulic cylinder to drive the hydraulic medium in the medium pipe to flow towards the hydraulic cylinder in forward direction and to return to the hydraulic tank reversely or stop the flow;

a control device for the said electromagnetic change-over valve;

a circuit pipe to connect the electromagnetic change-over valve and the hydraulic tank;

further comprise a overflow valve locate on the pipe between the high pressure pump and the medium return pipe.

5. A blasting device for premixed abrasive slurry jet described in claim 3, wherein the control device for diaphragm pump is check valve.

6. A blasting device for premixed abrasive slurry jet, comprise:

hydraulic cylinder, in which defines a hydraulic medium side and a slurry side separated from each other hermetically, and the hydraulic medium side and the slurry side have ports for medium or slurry entry in and out respectively;

hydraulic medium feeding system which is connected to the port of the cylinder for medium entry in and out through medium pipe;

slurry jet system which is connected to the port of the cylinder for slurry entry in and out through slurry pipe;

wherein the said cylinder has a telescopic sealed bladder to separate the hydraulic medium side and the slurry side;

wherein the feeding system of said hydraulic medium comprises:

a hydraulic tank which is connected to the port of the cylinder for medium entry in and out through the medium pipe;

a high pressure pump which is connected to the medium pipe between the hydraulic tank and the hydraulic cylinder to supply high pressure medium to the hydraulic cylinder;

a electromagnetic change-over valve which is located at the medium pipe between the high pressure pump and the hydraulic cylinder to drive the hydraulic medium in the medium pipe to flow towards the hydraulic cylinder in forward direction and to return to the hydraulic tank reversely or stop the flow;

a control device for the said electromagnetic change-over valve;

a circuit pipe to connect the electromagnetic change-over valve and the hydraulic tank;

wherein the control device for the said electromagnetic change-over valve comprise a high and a lower level controllers.

7. A blasting device for premixed abrasive slurry jet, comprise:

hydraulic cylinder, in which defines a hydraulic medium side and a slurry side separated from each other hermetically, and the hydraulic medium side and the slurry side have ports for medium or slurry entry in and out respectively;

hydraulic medium feeding system which is connected to the port of the cylinder for medium entry in and out through medium pipe;

slurry jet system which is connected to the port of the cylinder for slurry entry in and out through slurry pipe;

wherein the said cylinder has a telescopic sealed bladder to separate the hydraulic medium side and the slurry side;

wherein a bladder sensor fitted on the port of the said cylinder block.

* * * * *